United States Patent [19]

Jiruse et al.

[11] 4,324,180

[45] Apr. 13, 1982

[54] DRIVE DEVICE

[75] Inventors: Jaroslav Jiruse, Blansko; Antonin Svobodova, Adamov, both of Czechoslovakia

[73] Assignee: Adamovske Strojirny, Narodni Podnik, Adamov, Czechoslovcakia

[21] Appl. No.: 188,061

[22] Filed: Sep. 17, 1980

[30] Foreign Application Priority Data

Sep. 22, 1979 [CS] Czechoslovakia ..... 6397-79

[51] Int. Cl.[3] ..... B41F 5/00

[52] U.S. Cl. ..... 101/216; 74/411.5; 192/0.07

[58] Field of Search ..... 101/212, 216, 217; 192/0.02 R, 0.03, 0.04, 0.052, 0.055, 0.08, 0.07, 0.072; 74/380, 335, 469, 336 R, 142, 411.5

[56] References Cited

U.S. PATENT DOCUMENTS

| | | | |
|---|---|---|---|
| 2,824,457 | 2/1958 | Norton | 101/216 X |
| 3,742,244 | 6/1973 | Raible | 101/216 X |
| 3,956,985 | 5/1976 | Ishii | 101/217 X |
| 4,000,242 | 12/1976 | Hartbauer | 101/216 X |

*Primary Examiner*—E. H. Eickholt

*Attorney, Agent, or Firm*—Burgess, Ryan & Wayne

[57] ABSTRACT

The invention relates to a drive device, particularly for offset printing machines, in which a control lever is mounted on a pin fixed in the side wall of the printing machine and is connected by means of an adjustable bar to a swing fork, in which a variable speed gear box is mounted, joined by means of a drive belt to a common pulley, which is linked intermediate of a V-belt to a free part of an electromagnetic clutch which is electromagnetically connected with the stationary part of said clutch. The stationary part of the clutch is mounted on a worm gear which engages a worm joined with an electric motor for the tip - motion of the printing cylinders.

The device provides the advantage, that the control of the variable speed gear box ratio is accomplished by a separate mechanism and the impulses for increasing or decreasing the number of revolutions of the printing machine is effected electrically.

4 Claims, 4 Drawing Figures

DRIVE DEVICE

The present invention relates to a drive device for offset printing machines.

The invention is a drive device for offset printing machines which ensures a separately controlled continuous change of rotation speed and at the same time, a typing capability by use of a worm gear set and an electromagnetic clutch as a brake.

The drive device is designed to be mounted behind the printing stand.

Before the present invention, known devices for controlling the rotation speed of printing machines were for the most part fitting with commutator—direct current motors or with motors with an induction clutch fitted with an automatic controller. The automatic controller is fitted with an auxiliary governing motor. For typing, the device is fitted either with a separate motor or with a special controller for reversing rotation of the direct current motor.

When using the drive device with the induction clutch, the typing—because of irregular running—is done intermittently by the machine itself. For machine braking, the device is fitted with a special additional attachment or with special brakes.

A disadvantage of the known drive devices is their complexity and high cost. Another negative feature is the high space requirement, as a result of which, a part of the device has to be located in a separate housing from the printing machine.

Another drawback is a voltage swing in the feeding network which occurs when braking the machine.

Other known printing machine drive devices are belt or conic disc friction drives. Such devices are simple but have the disadvantage that typing can be done only intermittently and, only on the belt drive types. The braking of a machine driven in this way is accomplished only by the machine run out.

The aforementioned drawbacks are eliminated by a novel drive device according to the present invention, comprising a control lever, rotatably mounted on a pin, connected by means of an adjustable bar to a swinging fork, on which a variable speed gear box is mounted, joined by means of a drive belt to a common pulley which, via a V-belt, is linked to the free part of an electromagnetic clutch which can be electromagnetically connected with the driven part of the clutch. The driven part of the electromagnetic clutch is mounted on a worm gear which engages a worm turned by the typing (electric) motor. The common pulley is fixed on the shaft on which a drive gear is fixedly mounted which engages with the first idler gear fixedly mounted on the intermediate shaft on which the second idler gear, too, is fixedly mounted which is in mesh with the first countershaft gear fixed on the countershaft fitted with the second countershaft gear engaging with the turning roll gear. The second countershaft gear engages the driven unloader drum gear.

The advantages of the drive device consists in controlling the variable speed gear box ratio by means of a separate mechanism which doesn't depend on other machine attachments. The impulses for the printing machine speed reduction or increase are electrically provided.

A further advantage of the present device resides in the safety and manageability of typing by use of the electromagnetic clutch, because of the instantaneous reaction of the machine when starting or stopping it. The machine can be locked in the rest position by switching on the electromagnetic clutch. Another feature of the drive device is use of the worm gear as a resilient element for damping shock when braking, by use of the electromagnetic clutch.

Figure 1:
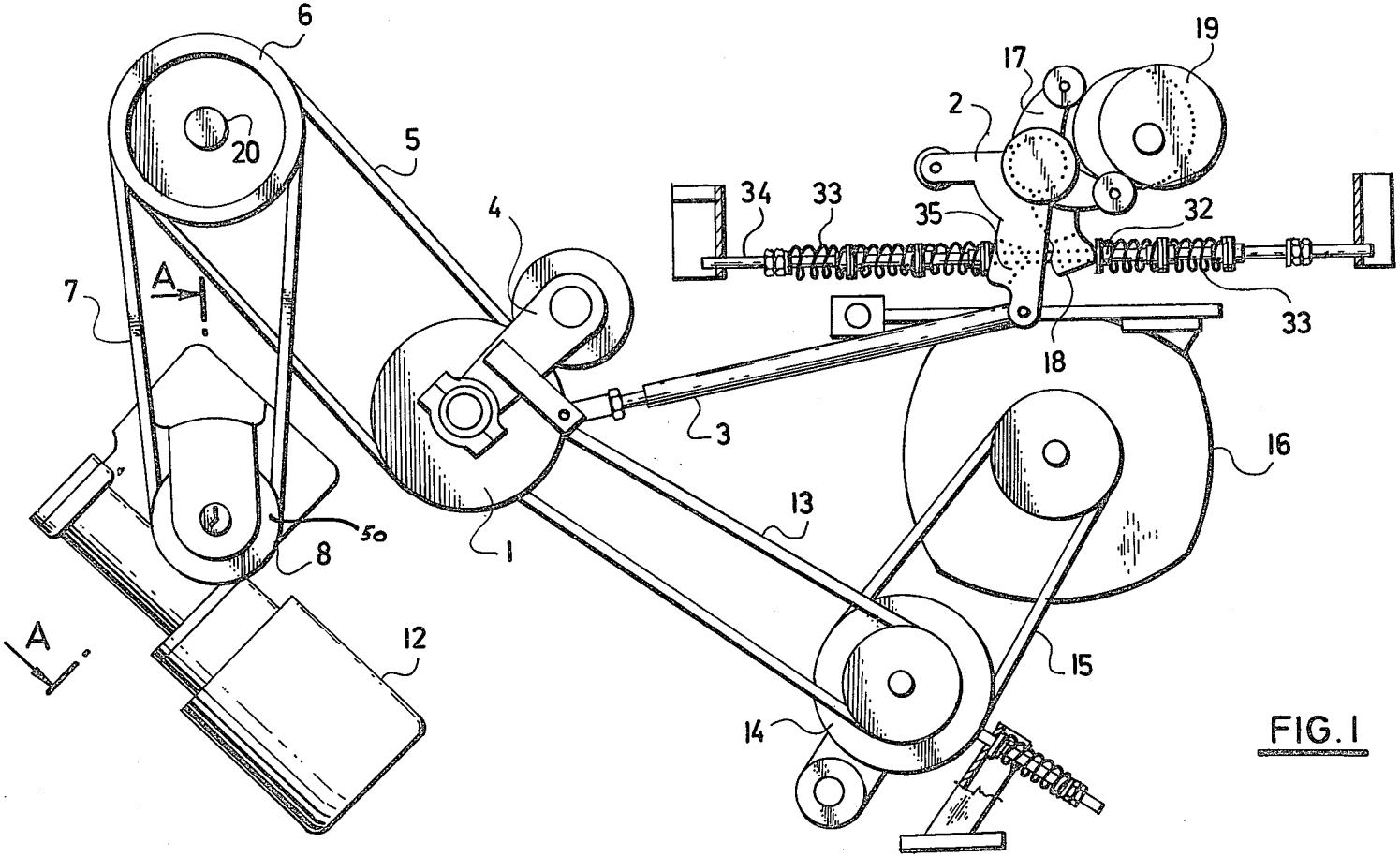
FIG. 1 represents the drive device in front view.

The drive device according to the invention comprises a variable speed gear box (1) mounted on a swinging fork (4). The swinging fork (4) is—by means of an adjustable draw bar (3)—connected to a control lever (2). The control lever (2) and the angular lever (17) are—rotatably mounted on—a common pin fixed in the printing machine side wall. The control lever (2) is fitted with a carrying projection (35) on which bear, alternatively, the discs (32).

The angular lever (17) is fitted with carrier (18) which engages with discs (32) mounted on the bar (34). The discs (32) are cushioned by means of springs (33) also placed on the bar (34).

The angular lever (17) is fitted with rollers which bear on the double cam (19) path forming part of the control mechanism for governing output of the variable speed gear box (1). The variable speed gear box output speed is adjusted by its position relative to common pulley 6. The variable speed gear box can be of the type well known in the art which utilizes a spring loaded split pulley to adjust the speed dependent upon the tension applied to a V-belt drive. When a large amount of tension is applied to the V-belt, the V-belt forces the split pulley apart and rides on the pulley nearer the shaft on which the split pulley is mounted. If the split pulley is the output pulley, the V-belt rides over a smaller circumference and the speed is reduced. When the tension on the V-belt is reduced, the faces of the spring loaded split pulley are forced together and the V-belt rides higher on the pulley, away from the shaft and the speed of the V-belt is increased. Variable speed devices of this type are well known in the art and are well suited for use in the present invention.

The printing machine is driven by electric motor drive (16) by means of a transfer pulley (14) and a V-belt (15). The transfer pulley (14) is—by means of a drive belt (13)—linked to the variable speed gear box (1). The variable speed gear box (1) is—by means of a drive belt (5)—linked to the common pulley (6) which is—via the V-belt, linked to the free part (8) of the electromagnetic clutch (50).

Figure 2:
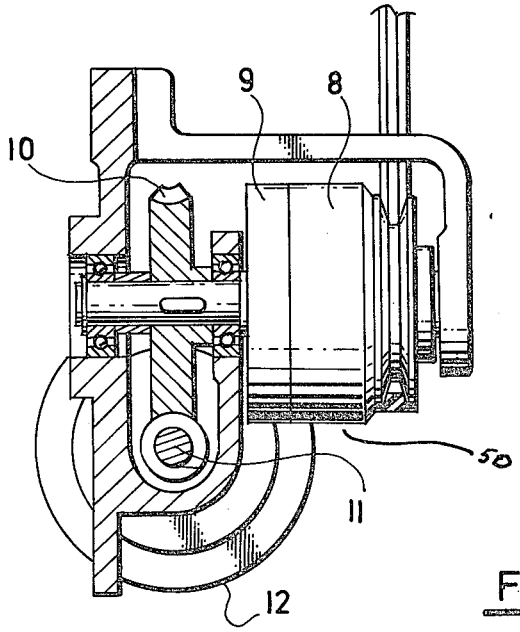
FIG. 2 is a broken section through the plane A—A of FIG. 1.
Figure 3:
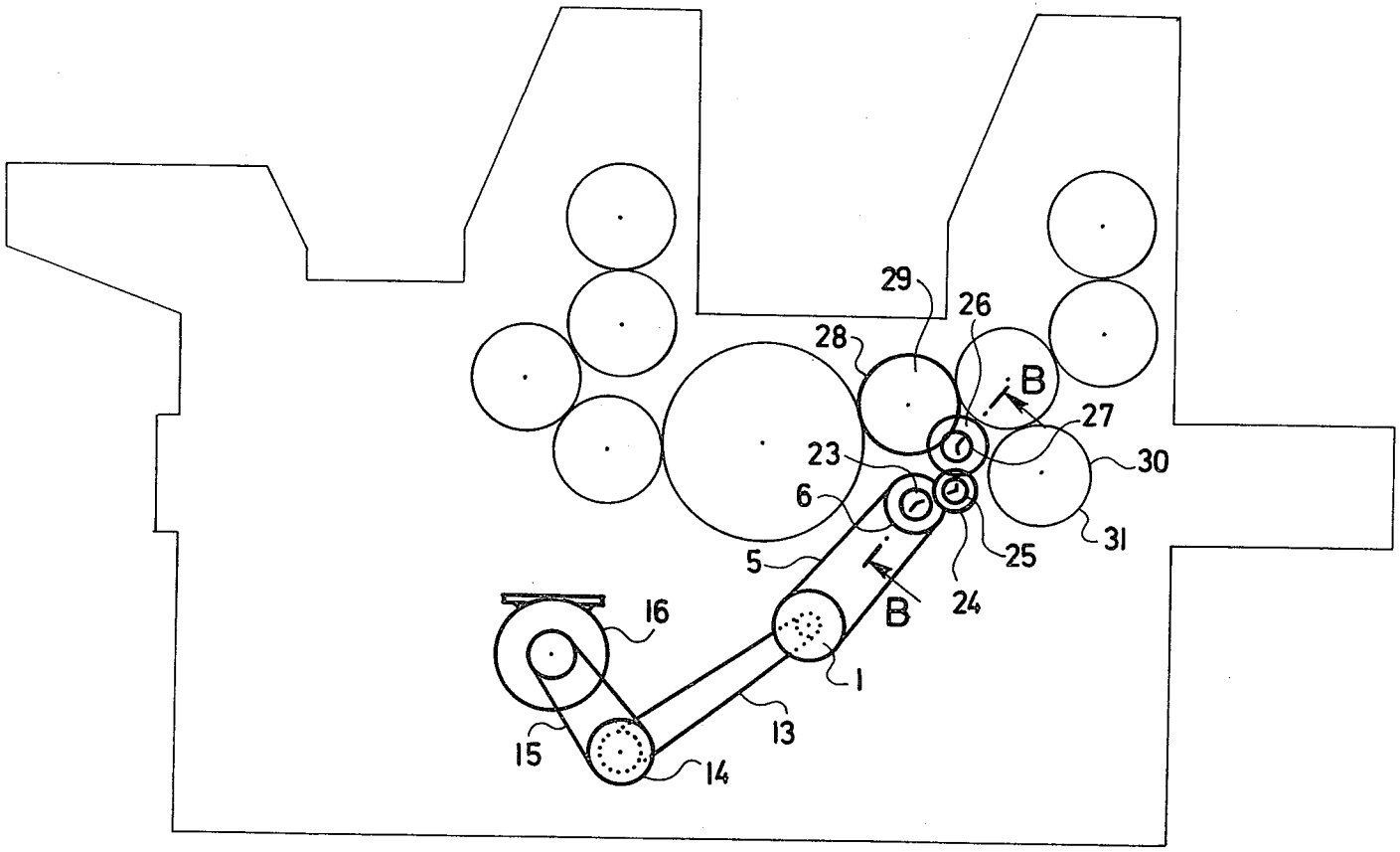
FIG. 3 is a side view of a printing machine with the drive device of the invention incorporated therein.

The driven part (9) of the electromagnetic clutch (50) is mounted on the shaft of worm gear (10) (FIG. 2), which engages worm (11). Worm (11) is rotated by typing (electric) motor (12).

Figure 4:
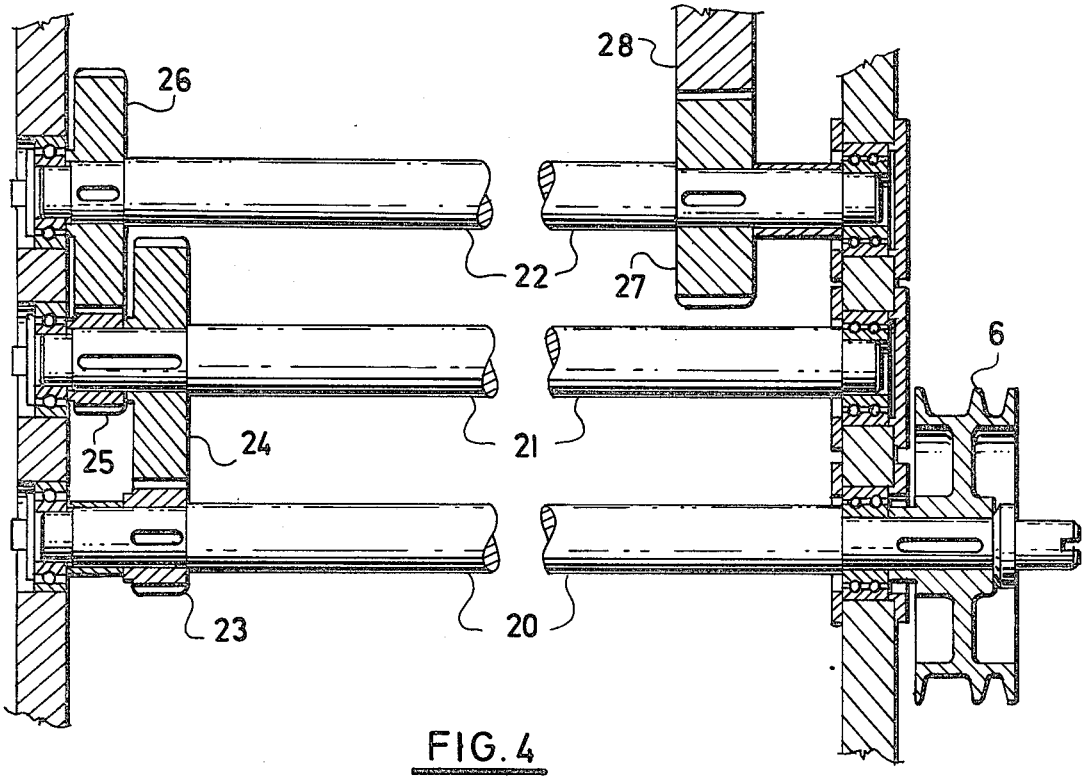
FIG. 4 is a section through the plane B—B of FIG. 3.

The common pulley (6) is mounted on shaft (20) on which a drive gear (23) is fixed. (FIG. 4). The drive gear (23) is in mesh with the first idler gear (24) fixedly mounted on an intermediate shaft (21). On the intermediate shaft (21), is also fixedly mounted the second idler gear (25) which is in mesh with the first countershaft gear (26) fixedly mounted on the countershaft (22). On the countershaft (22), the second countershaft gear (27)

is fixedly mounted, which engages with the roll turning gears (28, 29).

In an alternative arrangement, the intermediate shaft (21) (including the gears) is replaced by the countershaft (22) so that the second countershaft gear (27) engages with the driven gear (30) of the unloader drum (31).

The present drive device operates as follows: The desired printing machine speed changes while the machine is running so that in idle running, the engine rotates at a minimum speed and in printing, at higher revolutions according to the choice of the operator of the kind of work being done.

Increase or reduction of printing machine speed is controlled by the double cam (19) which governs and resets the angular lever (17) with carrier (18) by means of cushioned discs (32), urged together by springs (33). At the same time, the discs (32) carry—via carrying projection (35)—the control lever (2) which moves—by means of an adjustable draw bar (3)—the swinging fork (4). In this way, the output rotational speed of variable speed gear box (1) is reset which changes the common pulley (6) speed so that—continuously and without shock—the printing machine rotational speed is changed.

The minimum printing machine speed is set by adjusting the length of the adjustable draw bar 3, by means of a screw. When the adjustable draw bar (3) is shortened, the variable speed gear box (1) is reset in a position corresponding to a desired reduced revolution speed. During typing, i.e., the slow machine speed during setup for printing, the printing machine is rotated by typing motor (12) controlled by push buttons, which rotate the driven part of electromagnetic clutch (9), which is electromagnetically coupled with its free part (8). From the free part of the electromagnetic clutch, the rotation is transferred via the common pulley (6) to the printing machine as a whole.

When the printing machine is operating at printing speed, the driven part (9) of the electromagnetic clutch is uncoupled from free part (8). The driven part (9) of said clutch does not rotate when the free part (8) has no load, i.e., typing motor (12) is not in operation.

The braking of the printing machine is done when the driving motor (16) is switched off and, at the same time, the free part of the electromagnetic clutch (8) is coupled with its part (9). In this way, with very little stationary slip, the printing machine is braked. Further shock damping (when stopping the printing machine rapidly) is obtained by securing the electromagnetic clutch stationary part (9) to the worm gear (10) which engages with the worm (11), the lead of which is close, to its self-locking limit.

When braking is initiated, the worm gearing functions as a resilient element for shock damping.

We claim:

1. A drive device for an offset printing machine which comprises a drive motor, operatively connected to a variable speed belt drive mounted on a swinging support, which is pivotally connected to a first end of an adjustable draw bar, the second end of the draw bar is pivotally connected to a control lever pivotally mounted on the printing machine, the variable speed belt drive is connected by means of a first drive belt to a common pulley which is operatively connected to the printing machine, a second belt which engages with the common pulley is linked to a pulley mounted on a freely rotating shaft of an electromagnetic clutch means whereby when the power to the drive motor is stopped, the electromagnetic clutch means can be activated to affect the rotation of the machine through a drive part.

2. The drive device of claim 1 wherein the drive part of the electromagnetic clutch means is fixedly mounted on the shaft of a worm gear which is engaged with a worm drive of a typing motor.

3. The drive device of claim 1 or 2 wherein the common pulley is fixedly mounted on a rotatable shaft on which is fixedly mounted a first drive gear which engages a first idler gear fixedly mounted on a second rotatable shaft on which is fixedly mounted a second idler gear, which engages a first countershaft gear fixedly mounted on a countershaft carrying a second fixedly mounted countershaft gear which engages a roll turning gear.

4. The drive device of claim 3, wherein the second countershaft gear engages with an unloader drum drive gear.

* * * * *

UNITED STATES PATENT AND TRADEMARK OFFICE

CERTIFICATE OF CORRECTION

PATENT NO. : 4,324,180

DATED : April 13, 1982

INVENTOR(S) : Jaroslav Jiruse, et al

It is certified that error appears in the above—identified patent and that said Letters Patent is hereby corrected as shown below:

Item [75]: the name "Svobodova" should be --Svoboda--.

Signed and Sealed this

*Fifteenth* Day of *February 1983*

[SEAL]

*Attest:*

GERALD J. MOSSINGHOFF

*Attesting Officer*

*Commissioner of Patents and Trademarks*